US010167591B1

(12) United States Patent
Rodgers, Jr.

(10) Patent No.: US 10,167,591 B1
(45) Date of Patent: Jan. 1, 2019

(54) LAUNDRY HAMPER WITH ROTATING HANDLE AND GRIP

(71) Applicant: Michael D Rodgers, Jr., Carlsbad, CA (US)

(72) Inventor: Michael D Rodgers, Jr., Carlsbad, CA (US)

( * ) Notice: Subject to any disclaimer, the term of this patent is extended or adjusted under 35 U.S.C. 154(b) by 0 days.

(21) Appl. No.: 15/860,345

(22) Filed: Jan. 2, 2018

Related U.S. Application Data

(60) Provisional application No. 62/441,981, filed on Jan. 4, 2017.

(51) Int. Cl.
*B65D 25/28* (2006.01)
*D06F 95/00* (2006.01)
*D06F 93/00* (2006.01)

(52) U.S. Cl.
CPC ..... *D06F 95/002* (2013.01); *D06F 93/00* (2013.01)

(58) Field of Classification Search
CPC ... D06F 95/002; D06F 93/00; B65D 25/2855; B65D 25/2852; B65D 25/2841
USPC ..... 220/755, 763, 764, 774
See application file for complete search history.

(56) References Cited

U.S. PATENT DOCUMENTS 1,376,126 A * 4/1921 Willett ..... A47J 47/18 16/435
D474,603 S * 5/2003 Berenguer ..... D3/307
2007/0062960 A1* 3/2007 Splain ..... A45C 3/04 220/669

* cited by examiner

*Primary Examiner* — Stephen Castellano

(57) ABSTRACT

A laundry hamper is adapted to contain articles of clothing in transit. The laundry hamper includes a basin with a bottom and four sides connected to a rounded upper lip. A first handle connection point is attached to the rounded upper lip proximate the first side. A second handle connection point is attached to the upper lip proximate the third side. A handle includes a first handle rotation attachment point is rotationally attached to the first handle connection point. A first handle riser portion is joined to the first handle rotation attachment point and a first handle rounded portion. A handle crossing portion is joined to the first and second handle rounded portions. A second handle riser portion is joined to the handle crossing portion and a second handle rotation attachment point. The second handle rotation attachment point is rotationally coupled to the second handle rotation attachment point.

4 Claims, 8 Drawing Sheets

LAUNDRY HAMPER WITH ROTATING HANDLE AND GRIP

RELATED APPLICATION

This application claims priority to provisional patent application U.S. Ser. No. 62/441,981 filed on Jan. 4, 2017, the entire contents of which is herein incorporated by reference.

BACKGROUND

The embodiments herein relate generally to handheld devices designed to move clothing.

Prior to embodiments of the disclosed invention, there were many needs for laundry hampers that were unfulfilled. For instance, there was a need for a user to carry a fully loaded laundry basket with one hand so that the user's free hand could easily open doors especially self-closing doors such as the type that may be found in the entrance to the garage, for fire safety reasons. There was a need for a user to carry a fully loaded laundry basket with one hand and clothes hanging from hangers and various other miscellaneous items (such as laundry detergent, bags, tools etc.) leaving the user's other hand to open doors.

There was a need for a one-handed laundry hamper to have a stiff rigid handle such that when the user's hand moved the handle, the entire hamper moved at the exact same time so there was no delay in the rest of the hamper moving forward, which could be the case if the handle is made of a fabric material. In the case of a fabric material, the hamper would "swing" backwards momentarily when the user is moving forward through the door, thus causing the hamper to get trapped in the door, especially if the door is self-closing.

There was a need for a one-handed hamper to have a stiff, rigid handle and a special grip, centered in the middle of the handle, with a concave shape on the under-side of the grip. The under-side concave shape was needed when the user was carrying items, because the user would likely place an arm through the handle and the grip. Specifically, there was a need to accommodate a human arm beneath a concave shape of the grip, thus allowing the user to move the entire hamper at the same time, when the user's arm moves. Without such a grip having a concave under-side, the handle could slide in a perpendicular fashion across the user's arm thus causing the contents of the hamper to spill out. The concave under-side of the grip prevents any perpendicular sliding of the hamper.

There was a need for a stiff rigid handle that could be laid down out of and clear of the open top section of the hamper. This was necessary because if the handle was allowed to lie across the top open section of the hamper, when the user was placing clothes into the hamper, the clothes would collect on top of the handle requiring the user to later remove the clothes off the handle to place the clothes inside the body of the hamper.

There was a need for the stiff, rigid handle to stay in place when in the upright position and easily return downward. If the handle could not lock in the upright position, the handle would instead swing from one side of the top of the hamper to the other side. If a heavy item was placed on one side of the hamper, the hamper would roll forward and the contents will spill out.

Embodiments of the disclosed invention solve these problems.

SUMMARY

A laundry hamper is adapted to contain articles of clothing in transit. The laundry hamper comprises a basin, further comprising a bottom side, smoothly joined to a first side, a second side, a third side and a fourth side. A rounded upper lip is smoothly joined to the first side, the second side, the third side and the fourth side. A first handle connection point is attached to the rounded upper lip, proximate the first side. A second handle connection point is attached to the upper lip proximate the third side.

A handle further comprises a first handle rotation attachment point, rotationally attached to the first handle connection point. A first handle riser portion is joined to the first handle rotation attachment point and a first handle rounded portion. A handle crossing portion is joined to the first handle rounded portion and a second handle rounded portion. A second handle riser portion is joined to the handle crossing portion and a second handle rotation attachment point. The second handle rotation attachment point is rotationally coupled to the second handle rotation attachment point.

A handle grip is joined to the handle crossing portion and further comprises a generally cylindrical portion, joined to a first end conical portion and a second end conical portion. An inner concave portion and an outer concave portion are formed within the generally cylindrical portion. The inner concave portion extends a depth measured from a line drawn between the first end conical portion and the second end conical portion to a point on the inner concave portion which is most proximate a central axis of the generally cylindrical portion. The depth is at least three times as large as a corresponding depth on the outer concave portion.

The handle further comprises a handle length, measured from a basin center line that bisects the first side and the first handle connection point to a handle grip distal point. The basin further comprises a basin segment length, measured from the basin center line to a distal point on the rounded upper lip furthest from the second side. The basin segment length is at least twenty percent greater than the handle length.

In some embodiments, a first handle stop is formed on the first handle rotation attachment point. A second handle stop is formed on the second handle rotation attachment point. Rotating the handle from the fourth side to the second side causes the first handle stop and the second handle stop to contact the rounded upper lip such that the first handle riser portion and the second handle riser portion are parallel to the basin center line.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
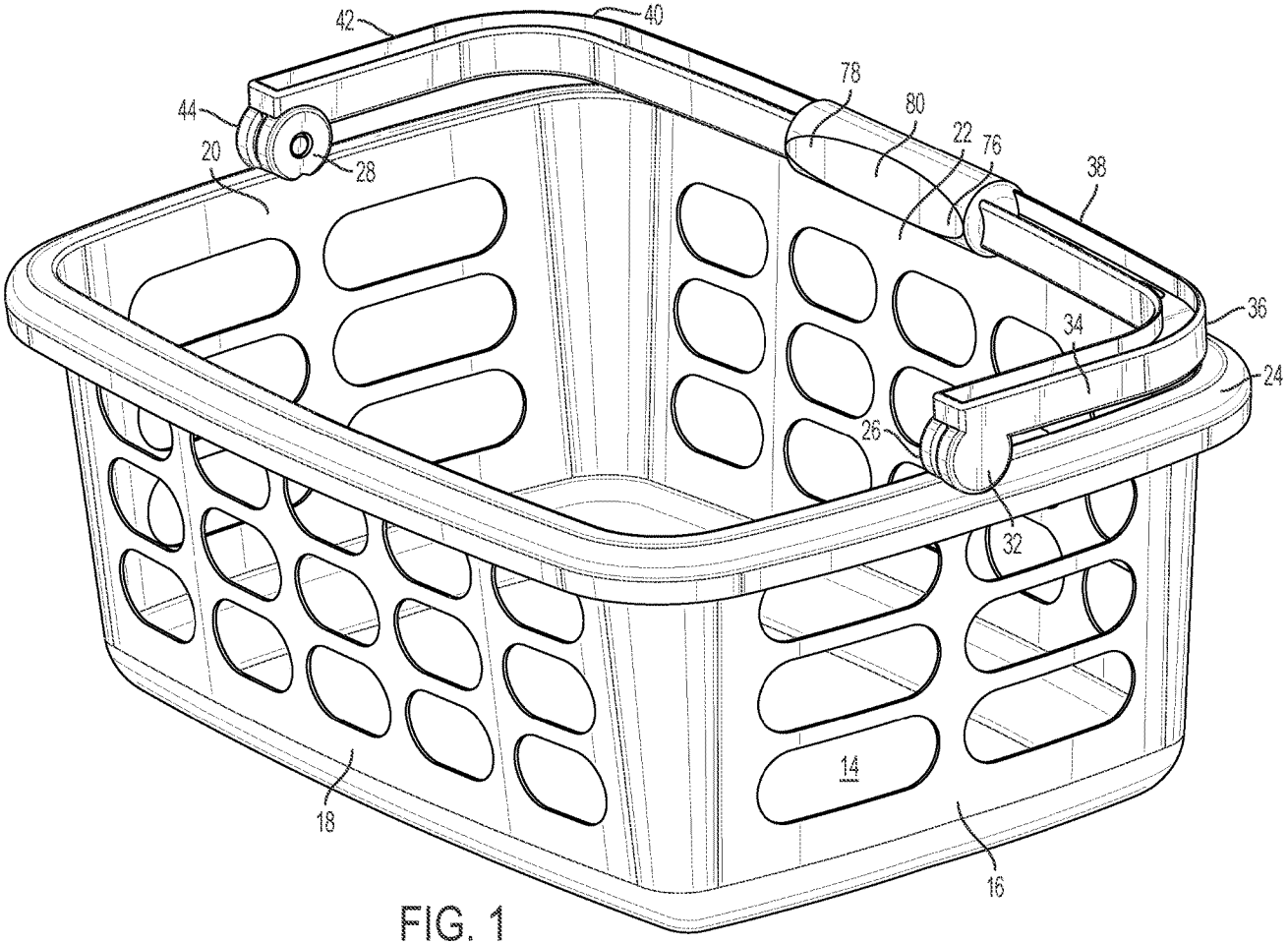
FIG. 1 shows a perspective view of one embodiment of the present invention.
Figure 2:
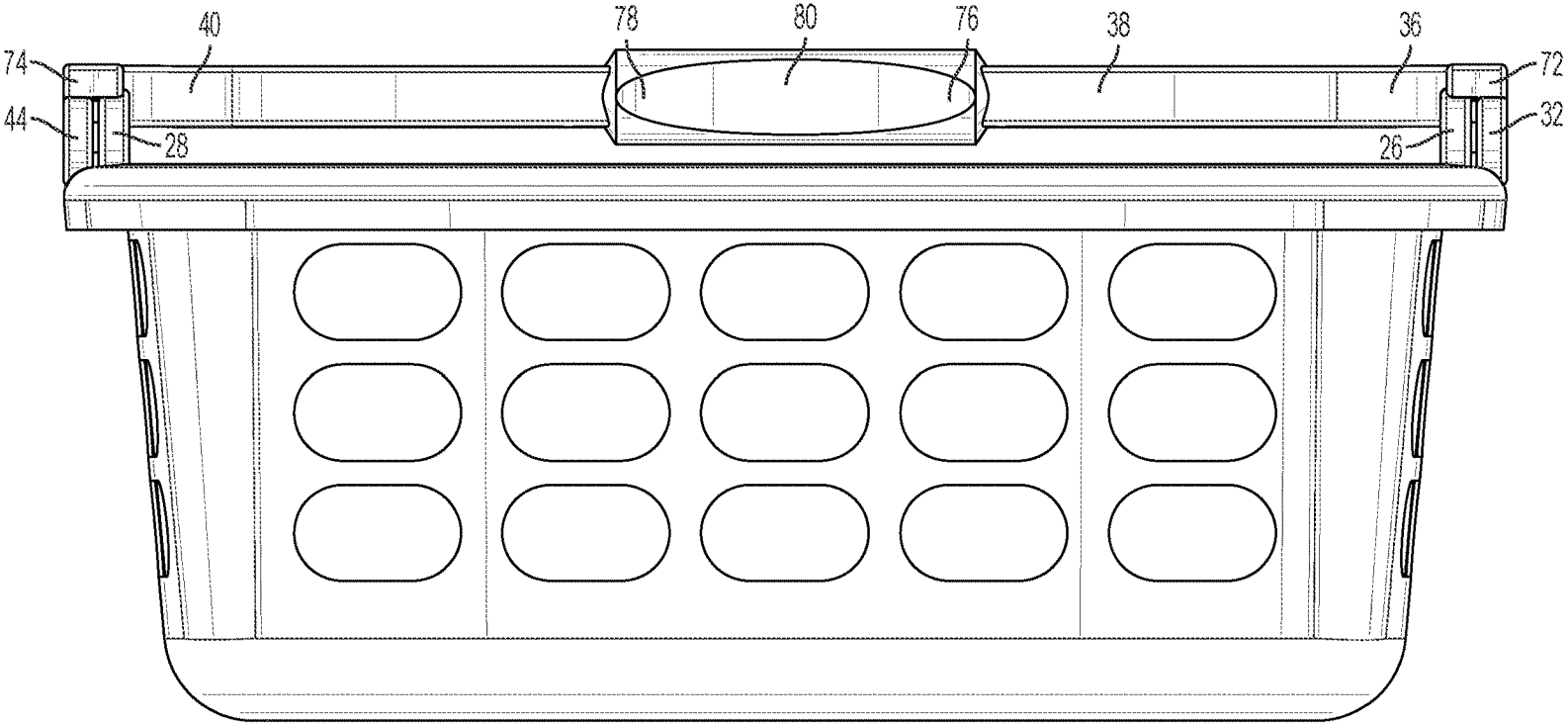
FIG. 2 shows a front view of one embodiment of the present invention.
Figure 3:
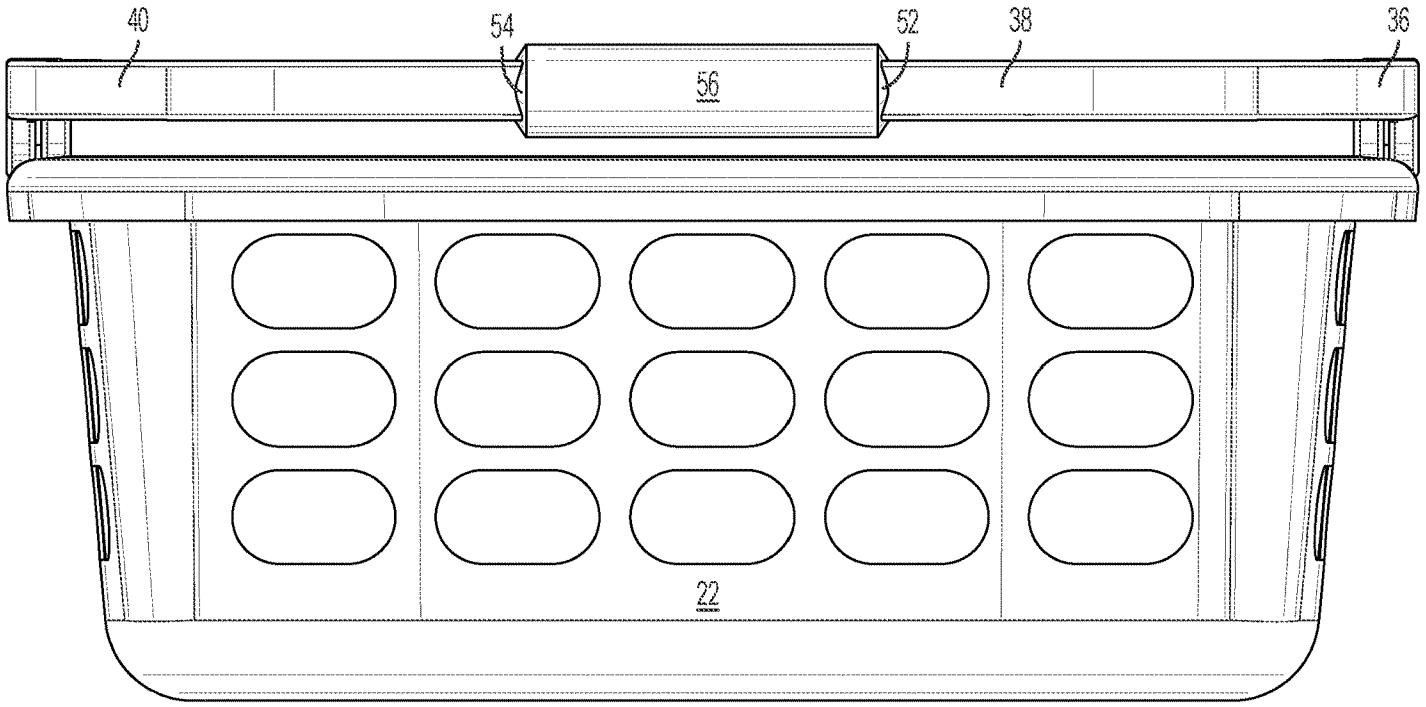
FIG. 3 shows a rear view of one embodiment of the present invention.
Figure 4:
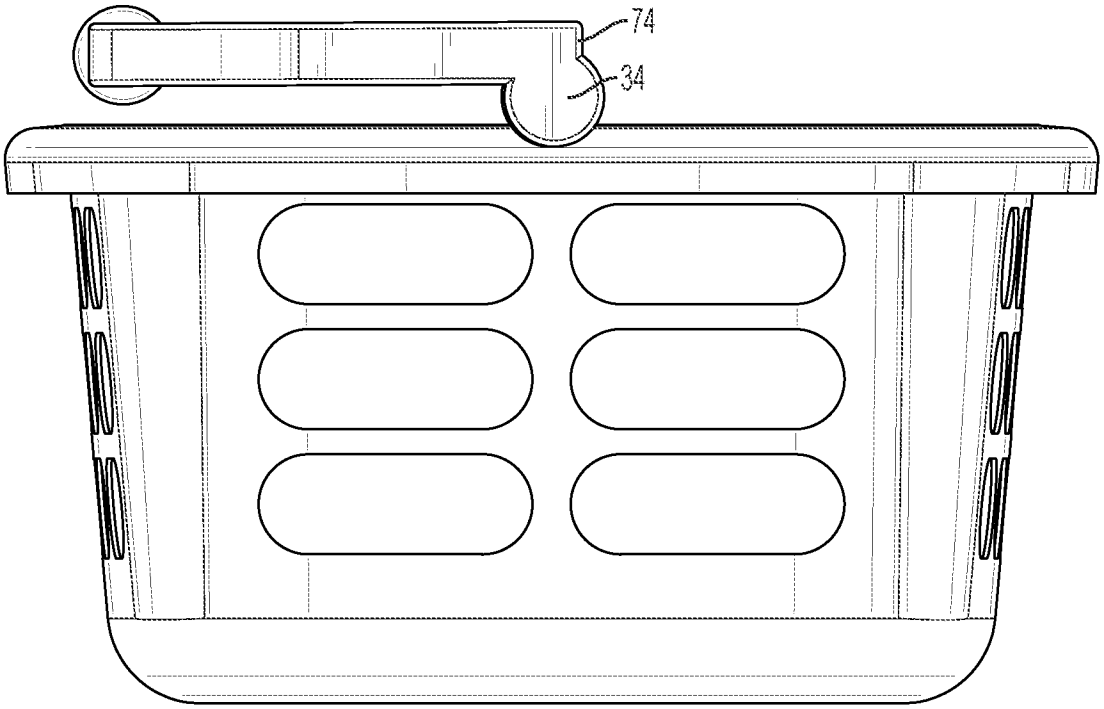
FIG. 4 shows a first side view of one embodiment of the present invention.
Figure 5:
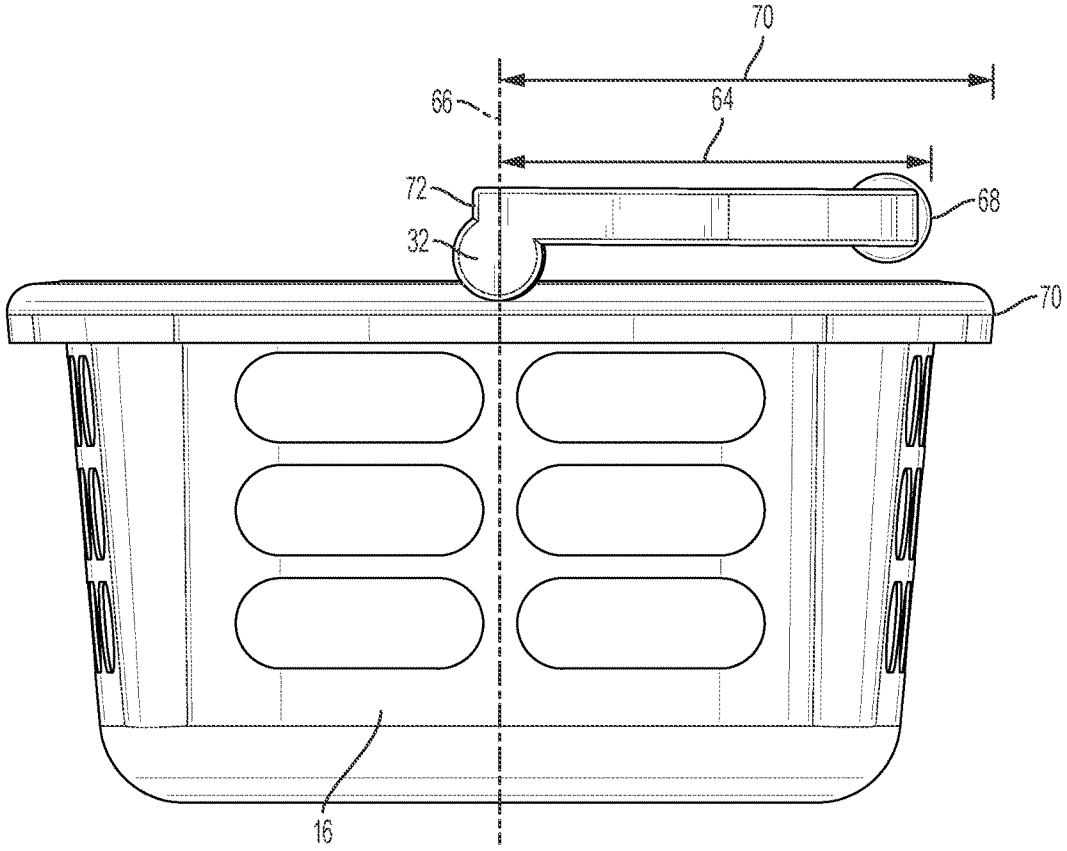
FIG. 5 shows an opposite side view of one embodiment of the present invention.
Figure 6:
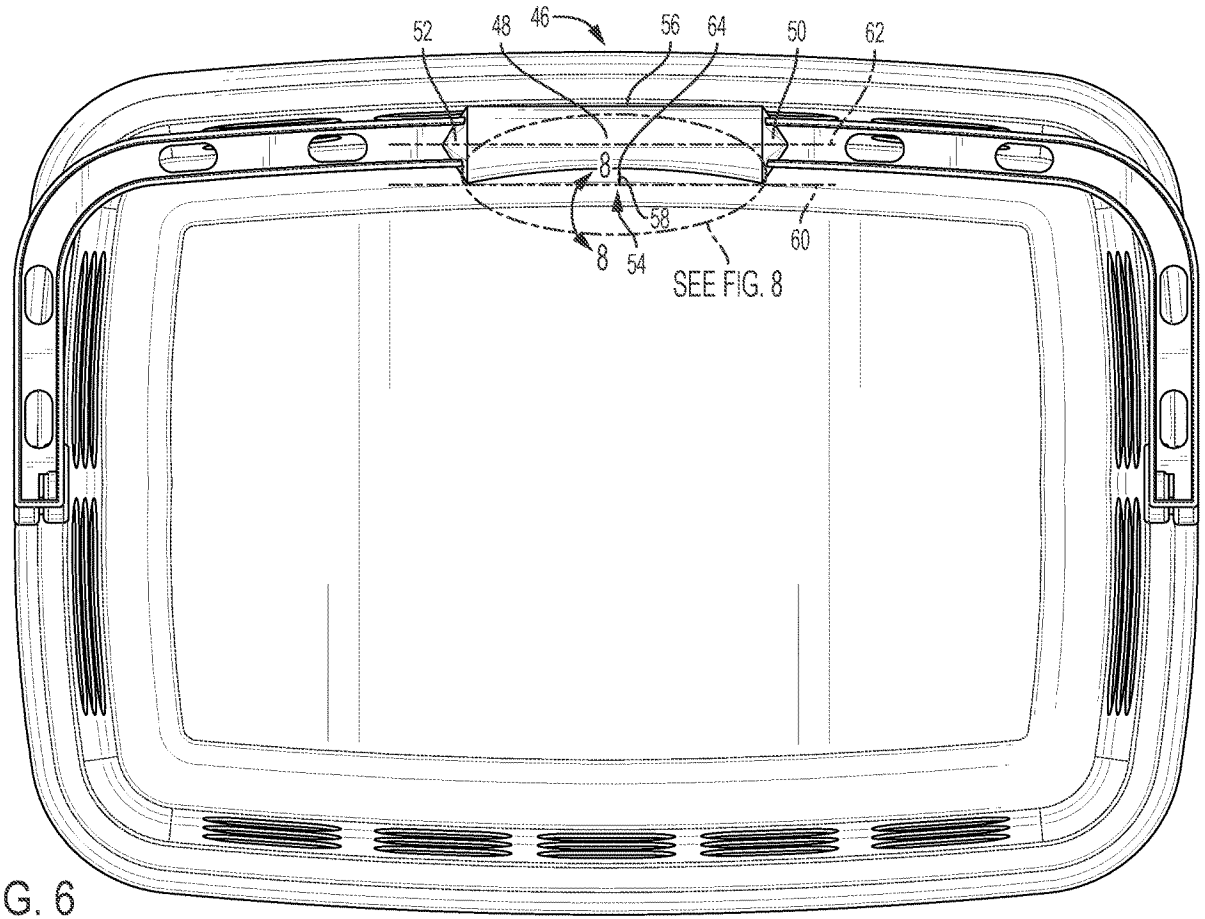
FIG. 6 shows a top view of one embodiment of the present invention.
Figure 7:
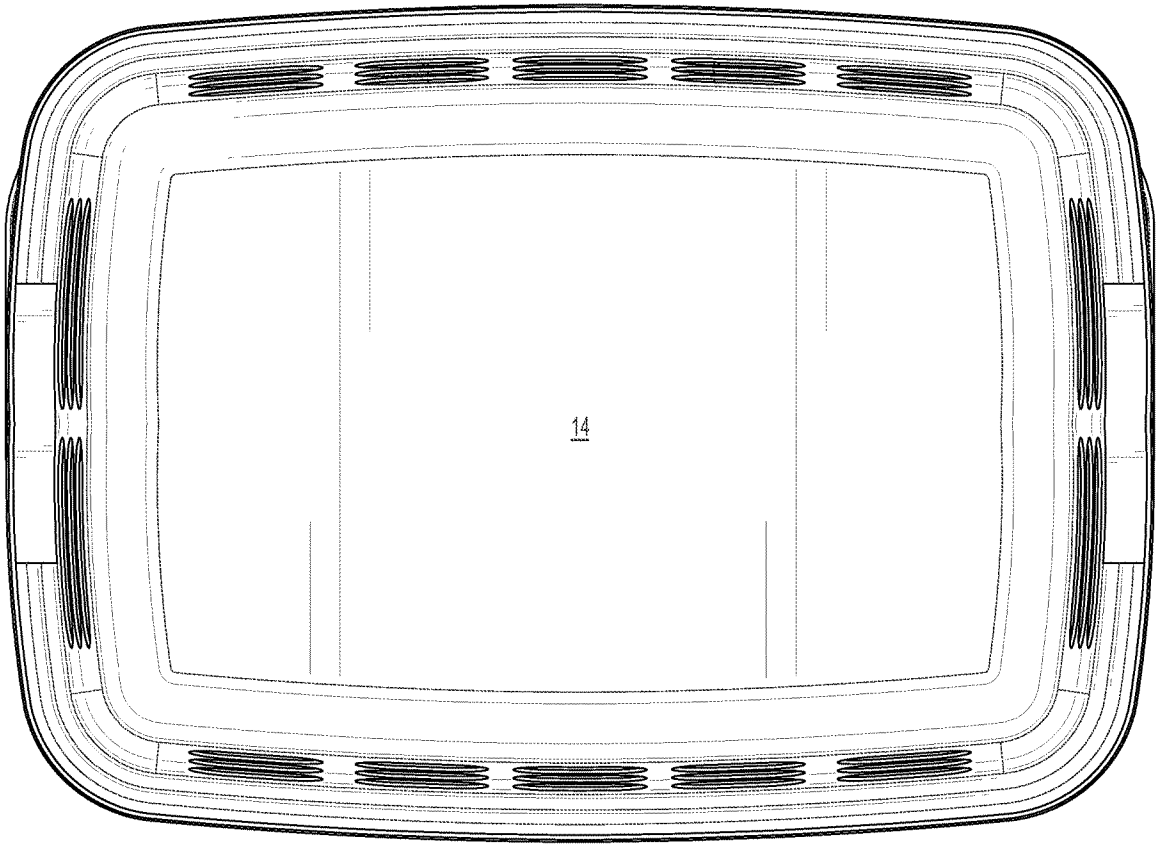
FIG. 7 shows a bottom view of one embodiment of the present invention.
Figure 8:
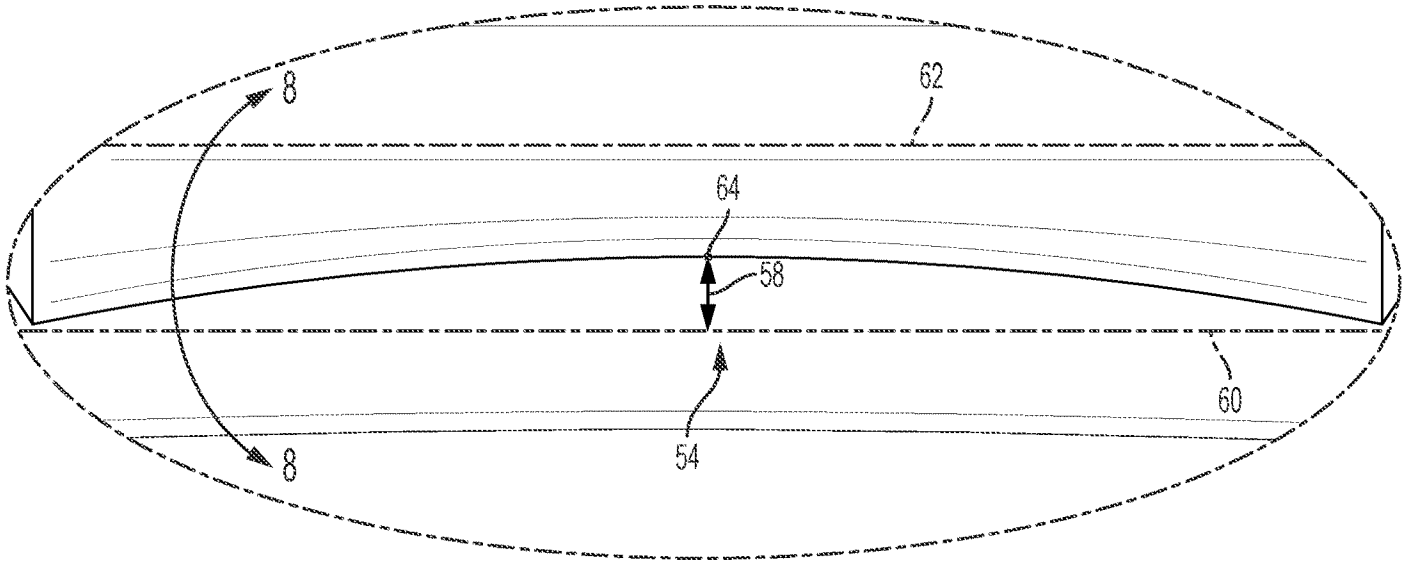
FIG. 8 shows a detail section view of one embodiment of the present invention.

By way of example, and referring to FIGS. 1-7, one embodiment of a laundry hamper 10 further comprises a basin 12 that is adapted to contain articles of clothing (not shown). The basin further comprises a bottom 14 which is smoothly joined to a first side 16, a second side 18, a third side 20 and a fourth side 22. A rounded upper lip 24 is further smoothly joined to the first side 16, the second side 18, the third side 20 and the fourth side 22.

The rounded upper lip 24, proximate the first side 16, is attached to a first handle connection point 26. The rounded upper lip 24, proximate the third side 20, is attached to a second handle connection point 28.

A handle 30 further comprise a first handle rotation attachment point 32 which is rotationally attached to the first handle connection point 26. The first handle rotation attachment point 32 is joined to a first handle riser portion 34. The first handle riser portion 34 is joined to a first handle rounded portion 36. The first handle rounded portion 36 is joined to a handle crossing portion 38. The handle crossing portion 38 is joined to a second handle rounded portion 40. The second handle rounded portion 40 is joined to a second handle riser portion 42. The second handle riser portion 42 is rotationally connected to the second handle connection point 28 with a second handle rotation attachment point 44.

The handle crossing portion 38 is joined to a handle grip 46. The handle grip 46 further comprises a generally cylindrical portion 48 joined to a first end conical portion 50 and a second end conical portion 52. The generally cylindrical portion 48 further comprises an inner concave portion 54 and an outer concave portion 56. The inner concave portion 54 extends a depth 58 that can be measured from a line 60 drawn between the first end conical portion 50 and the second end conical portion 52 to a point 64 on the inner concave portion 54 which is most proximate a central axis 62 of the generally cylindrical portion 48. The depth 58 should be at least three times as large as a corresponding depth on the outer concave portion 56.

The handle 30 further comprises a handle length 64 which can be measured from a basin center line 66 that bisects the first side 16 and the first handle connection point 26 to handle grip distal point 68. The basin 12 further comprises a basin segment length that can be measured from the basin center line 66 to a distal point 70 on the lip furthest from the second side 18. The basin segment length should be at least twenty percent larger than the handle length The first handle rotation attachment point 32 can further comprise a first handle stop 72. The second handle rotation attachment point 34 can further comprise a second handle stop 74. When a user rotates the handle 30 from the fourth side 22 to the second side 18, the first handle stop 72 and the second handle stop 74 contact the upper lip 24 such that the first handle riser portion 34 and the second handle riser portion 34 are parallel to the basin center line 66.

In some embodiments, the inner concave portion 54 can further comprise a first inner angled portion 76 and a second inner angled portion 78 with a substantially planer portion 80 therebetween.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

As used in this application "smooth" means smooth enough to accomplish the inventor's purpose. Therefore, "smoothly connected" means "connected with a rounded portion without a deformity that would cause an injury to a human user."

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶ 6. In particular, any use of "step of" in the claims is not intended to invoke the provision of 35 U.S.C. § 112, ¶ 6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A laundry hamper, adapted to contain articles of clothing in transit; the laundry hamper comprising:

a basin, further comprising:

a bottom side, smoothly joined to a first side, a second side, a third side and a fourth side;

a rounded upper lip is smoothly joined to the first side, the second side, the third side and the fourth side;

a first handle connection point, attached to the rounded upper lip, proximate the first side;

a second handle connection point, attached to the upper lip, proximate the third side;

a handle, further comprising:

a first handle rotation attachment point, rotationally attached to the first handle connection point;

a first handle riser portion, joined to the first handle rotation attachment point and a first handle rounded portion;

a handle crossing portion, joined to the first handle rounded portion and a second handle rounded portion;

a second handle riser portion, joined to the handle crossing portion and a second handle rotation attachment point; wherein the second handle rotation attachment point is rotationally coupled to the second handle rotation attachment point;

a handle grip, joined to the handle crossing portion and further comprising:

a generally cylindrical portion, joined to a first end conical portion and a second end conical portion; and an inner concave portion and an outer concave portion, formed within the generally cylindrical portion; wherein the inner concave portion extends a depth measured from a line drawn between the first end conical portion and the second end conical portion to a point on the inner concave portion which is most proximate a central axis of the generally cylindrical portion.

2. The laundry hamper, of claim 1, wherein the depth is at least three times as large as a corresponding depth on the outer concave portion.

3. A laundry hamper, adapted to contain articles of clothing in transit; the laundry hamper comprising:

a basin, further comprising:

a bottom side, smoothly joined to a first side, a second side, a third side and a fourth side;

a rounded upper lip is smoothly joined to the first side, the second side, the third side and the fourth side;

a first handle connection point, attached to the rounded upper lip, proximate the first side;

a second handle connection point, attached to the upper lip, proximate the third side;

a handle, further comprising:

a first handle rotation attachment point, rotationally attached to the first handle connection point;

a first handle riser portion, joined to the first handle rotation attachment point and a first handle rounded portion;

a handle crossing portion, joined to the first handle rounded portion and a second handle rounded portion;

a second handle riser portion, joined to the handle crossing portion and a second handle rotation attachment point; wherein the second handle rotation attachment point is rotationally coupled to the second handle rotation attachment point;

wherein the handle further comprises a handle length, measured from a basin center line that bisects the first side and the first handle connection point to a handle grip distal point;

wherein the basin further comprises a basin segment length, measured from the basin center line to a distal point on the rounded upper lip furthest from the second side;

wherein the basin segment length is at least twenty percent greater than the handle length.

4. The laundry hamper of claim 3, further comprising:

a first handle stop formed on the first handle rotation attachment point;

a second handle stop formed on the second handle rotation attachment point;

wherein rotating the handle from the fourth side to the second side causes the first handle stop and the second handle stop to contact the rounded upper lip such that the first handle riser portion and the second handle riser portion are parallel to the basin center line.

* * * * *